US008370967B2

(12) United States Patent
Chen

(10) Patent No.: US 8,370,967 B2
(45) Date of Patent: Feb. 12, 2013

(54) ADJUSTABLE HEAD BAND FOR A HELMET

(75) Inventor: Tai-Heng Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 708 days.

(21) Appl. No.: 12/588,596

(22) Filed: Oct. 21, 2009

(65) Prior Publication Data

US 2011/0088148 A1 Apr. 21, 2011

(51) Int. Cl.
*A42B 1/22* (2006.01)
*A42B 3/00* (2006.01)
*A42B 7/00* (2006.01)

(52) U.S. Cl. ..... 2/418; 2/414; 2/417; 2/421

(58) Field of Classification Search ..... 2/410, 7, 2/8.1, 8.2, 414, 415, 416, 417, 418, 419, 2/420, 421, 422, 424, 425, 183; 24/68, 68 B; D29/102, 122

See application file for complete search history.

(56) References Cited

U.S. PATENT DOCUMENTS 2,511,234 A * 6/1950 Anderson ..... 2/8.1
2,926,406 A * 3/1960 Edwards et al. ..... 24/68 B
3,214,809 A * 11/1965 Edwards ..... 24/68 B
5,960,652 A * 10/1999 Marmstad ..... 70/49
6,314,588 B1 * 11/2001 Fang ..... 2/418
6,966,074 B2 * 11/2005 Huh ..... 2/414
7,174,575 B1 * 2/2007 Scherer ..... 2/418
7,222,374 B2 * 5/2007 Musal et al. ..... 2/421
7,565,704 B2 7/2009 Wu
8,056,150 B2 * 11/2011 Stokes et al. ..... 2/417
8,161,576 B2 * 4/2012 Lemke et al. ..... 2/418
2007/0157372 A1 * 7/2007 Musal et al. ..... 2/410
2007/0266481 A1 * 11/2007 Alexander et al. ..... 2/414
2008/0092276 A1 4/2008 Chiang
2008/0092279 A1 4/2008 Chiang
2008/0109947 A1 * 5/2008 Dubois ..... 2/414
2008/0276354 A1 * 11/2008 Stokes et al. ..... 2/418
2010/0050325 A1 * 3/2010 Wang-Lee ..... 2/418
2010/0095438 A1 * 4/2010 Moelker ..... 2/418
2010/0170068 A1 * 7/2010 Musal ..... 24/68 D
2010/0281604 A1 * 11/2010 Grim et al. ..... 2/417

* cited by examiner

*Primary Examiner* — Shelley Self
*Assistant Examiner* — Jane Yoon
(74) *Attorney, Agent, or Firm* — Bacon & Thomas, PLLC

(57) ABSTRACT

An adjustable head band for a helmet has a base, a band, an adjusting wheel, a dial and a cover. The base has at least one pawl. The band is annular and is movably mounted through the base and has two toothed ends. The toothed ends correspond to each other. The adjusting wheel has a gear and a ratchet wheel. The gear engages the toothed ends of the band. The ratchet wheel engages the at least one pawl of the base. The dial is mounted on the adjusting wheel. The cover is mounted on the base. The adjustable head band is attached to a helmet and is convenient and easy to operate to allow customization of the helmet on a head.

11 Claims, 8 Drawing Sheets

ADJUSTABLE HEAD BAND FOR A HELMET

BACKGROUND OF THE INVENTION

1. Field of the Invention

The present invention relates to a helmet, and more particularly to an adjustable head band for a helmet.

2. Description of the Prior Arts

Helmets are worn on a head during a wide variety of activities, from construction and mining to sports, especially, riding motorcycles and bicycles.

Conventional adjustable helmet bands comprise a base having a ratchet mount, a ratchet dial and a band having two toothed ends. The ratchet dial is mounted on the ratchet mount, is limited to incremental rotation and has a gear. The toothed ends engage the gear so that the diameter of the band is adjusted by rotation of the ratchet wheel. However, since the band is flexible, the ratchet ends may flex and disengage the gear so a tight fit cannot be achieved and in an accident the head band may slip off.

To overcome the shortcomings, the present invention provides an adjustable head band for a helmet to mitigate or obviate the aforementioned problems.

SUMMARY OF THE INVENTION

The main object of the present invention is to provide an adjustable head band for a helmet.

An adjustable head band for a helmet comprises a base, a band, an adjusting wheel, a dial and a cover. The base has at least one pawl. The band is movably mounted through the base, and has two toothed ends disposed parallelly. The adjusting wheel has a gear and a ratchet wheel. The gear engages the toothed ends of the band. The ratchet wheel engages the at least one pawl of the base. The dial is mounted on the adjusting wheel. The cover is mounted on the base. The adjustable head band is attached to a helmet and by rotating the dial, the head band is fine tuned to hold the helmet stably on a head.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
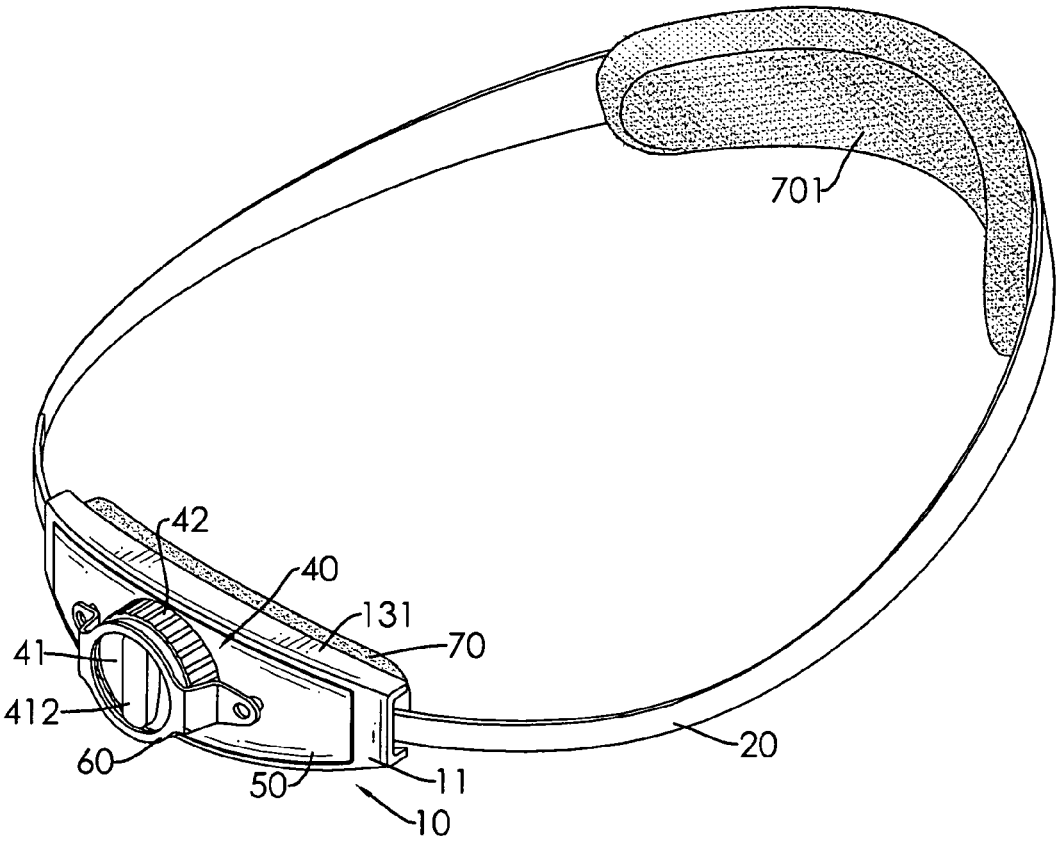
FIG. 1 is an operational perspective view of an adjustable head band for a helmet in accordance with the present invention.
Figure 2:
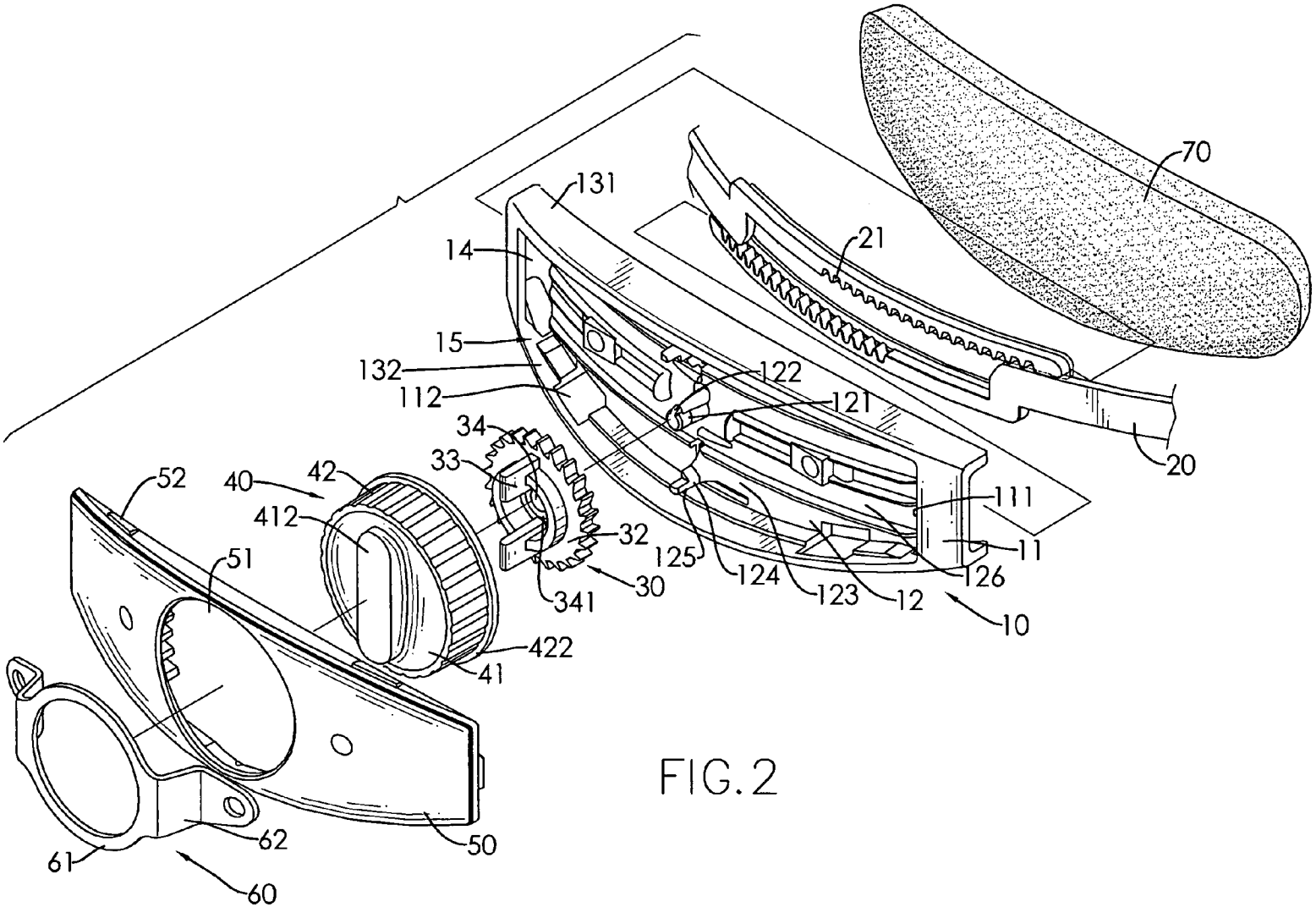
FIG. 2 is an enlarged, exploded perspective view of the adjustable head band for a helmet in FIG. 1.
Figure 5:
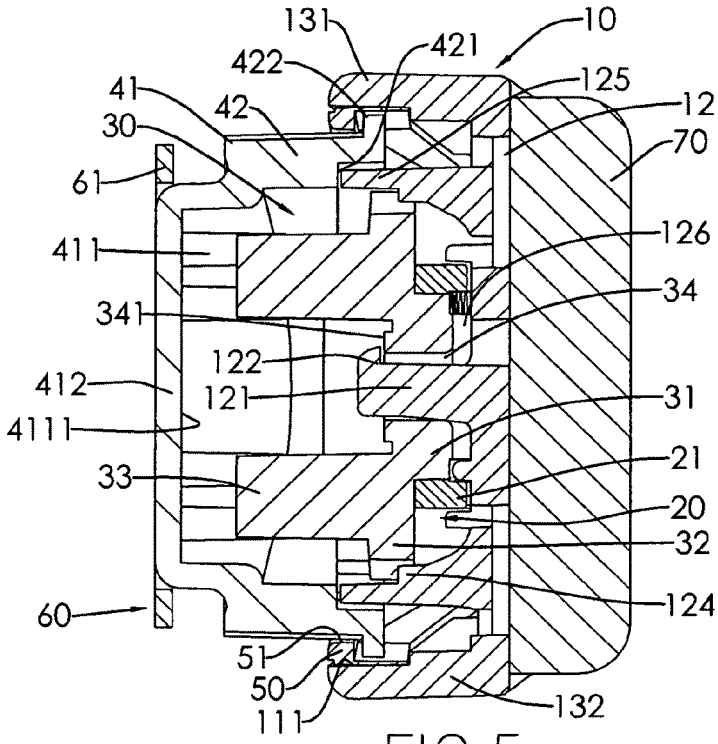
FIG. 5 is an operational end view in partial section of the adjustable head band for a helmet in FIG. 1, showing a pawl engaging the ratchet wheel.

With reference to FIGS. 1, 2 and 5, an adjustable head band for a helmet in accordance with the present invention comprises a base (10), a band (20), an adjusting wheel (30), a dial (40), a cover (50), a protector (60), an occipital pad (70) and a forehead pad (701).

Figure 3:
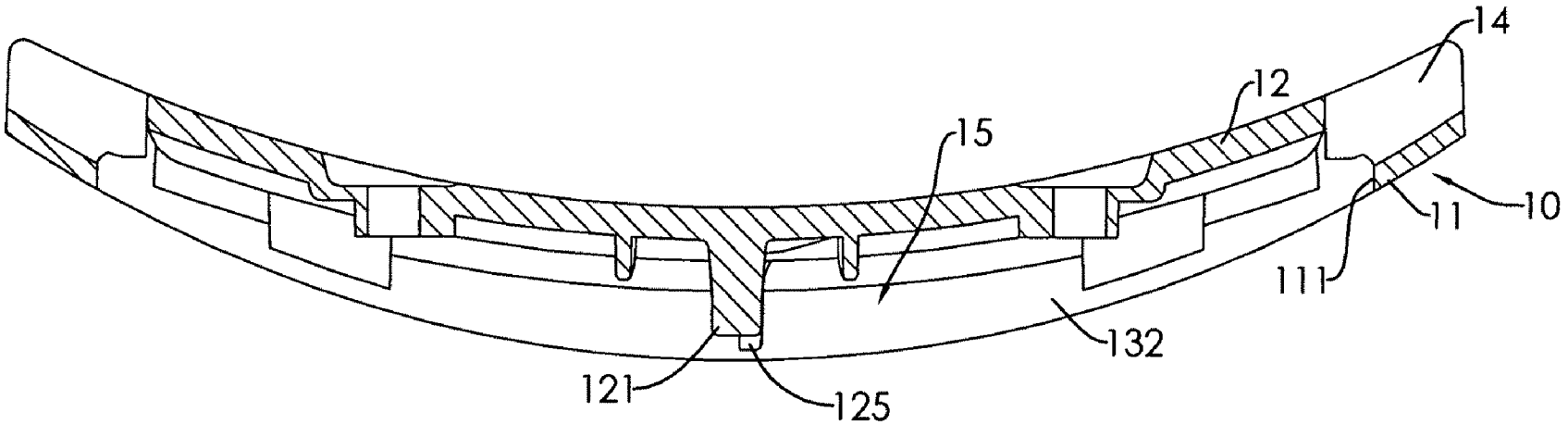
FIG. 3 is an enlarged top view in partial section of the base of the adjustable head band for a helmet in FIG. 1.

With further reference to FIG. 3, the base (10) has an outer frame (11), an inner panel (12), two slots (14) and a chamber (15). A5

The outer frame (11) has a front opening (111), an inside wall, multiple grooves (112), a top side (131), a bottom side (132) and two ends. The grooves (112) are formed in the inside wall of the outer frame (11).

The inner panel (12) has a front surface, a rear surface, a ratchet mount (121), at least one resilient sheet (123), two guiding grooves (126), a top side, a bottom side and two ends. The ratchet mount (121) protrudes from the front surface of the inner panel (12) and has an end and a mounting protrusion (122). The mounting protrusion (122) protrudes from the end of the ratchet mount (121). Each resilient sheet (123) is formed on the front surface of the inner panel (12) adjacent to the ratchet mount (121) and has a free end, a pawl (124) and an abutting protrusion (125). The pawl (124) protrudes from the free end of the resilient sheet (123) and has an end. The abutting protrusion (125) protrudes from the end of the pawl (124). In a preferred embodiment, the inner panel (12) has two resilient sheets (123). The guiding grooves (126) are formed separately on the front surface of the inner panel (12) and are respectively positioned above and below the ratchet mount (121). The top side and the bottom side of the inner panel (12) respectively correspond to and are connected to the top side (131) and the bottom side (132) of the outer frame (11). The slots (14) are formed respectively through the ends of the outer frame (11). The chamber (15) is defined between the outer frame (11) and the inner panel (12).

The band (20) is movably mounted through the base (10) and has two toothed ends (21). The toothed ends (21) are mounted respectively through the slots (14) of the base (10) and disposed in the chamber (15) of the base (10), and correspond to and are mounted respectively in the guiding grooves (126) of the base (10). Teeth of the toothed ends (21) face each other.

Figure 4:
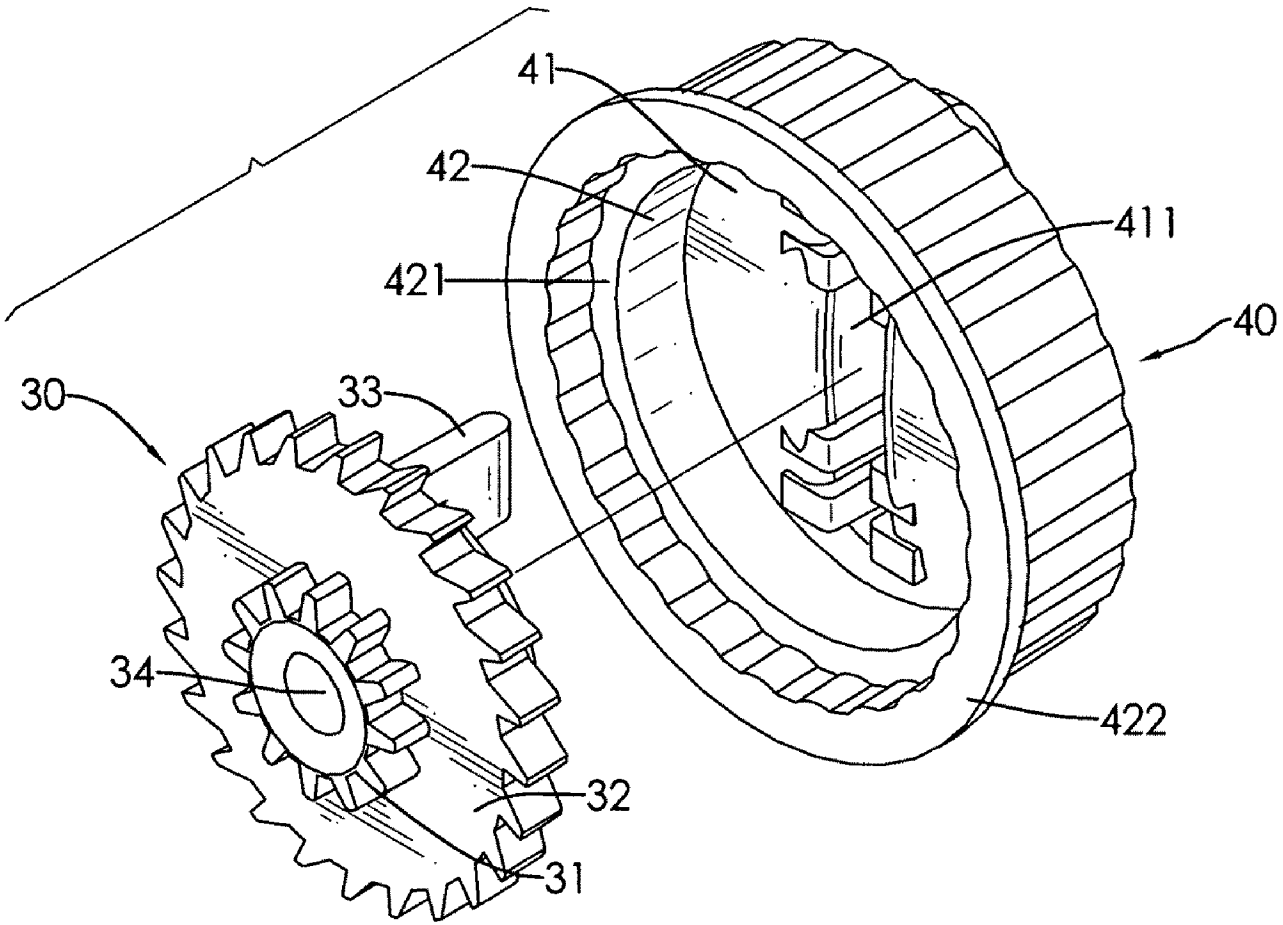
FIG. 4 is an enlarged exploded perspective view of an adjusting wheel and dial of the adjustable head band for a helmet in FIG. 1.
Figure 7:
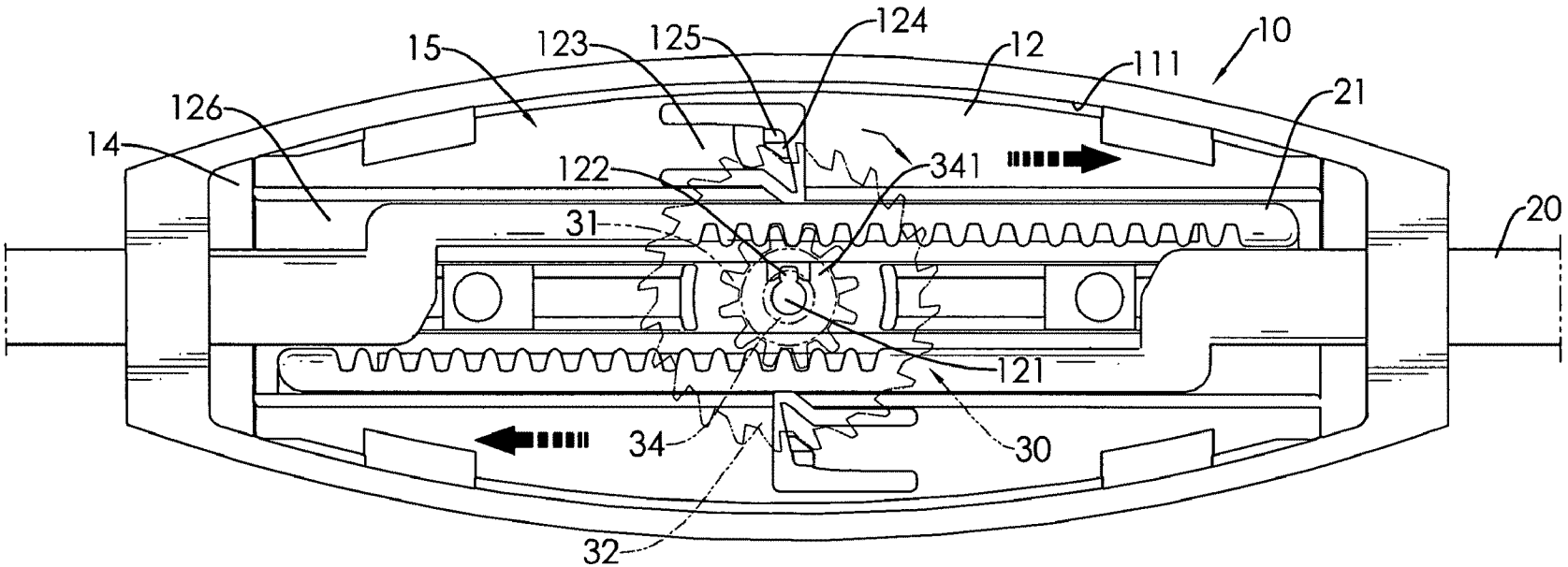
FIG. 7 is a partially operational enlarged front view of internal elements of the adjustable head band for a helmet in FIG. 1, showing the adjusting wheel moving clockwise.

With further reference to FIGS. 4 and 7, the adjusting wheel (30) is mounted on the base (10) and has a gear (31), a ratchet wheel (32), at least one connecting protrusion (33) and a center hole (34). The gear (31) is disposed between and engages the toothed ends (21) of the band (20). The ratchet wheel (32) is attached concentrically to the gear (31), is disposed between and engages the pawls (124) of the base (10) and has a surface. Each connecting protrusion (33) protrudes from the surface of the ratchet wheel (32). The center hole (34) is formed through the gear (31) and the ratchet wheel (32), is mounted around the ratchet mount (121) of the base (10) and has an inside wall (341). The inside wall (341) abuts the mounting protrusion (122) of the base (10) to position the adjusting wheel (30) on the base (10).

The dial (40) is mounted rotatably on the adjusting wheel (30) by the at least one connecting protrusion (33) and has a closed front (41), an open rear and an annular sidewall (42). The closed front (41) has an inner surface, an outer surface, a recess (411) (reference to FIG. 5) and an actuating unit (412). The recess (411) is formed in the inner surface of the closed front (41), is mounted on the connecting protrusion (33) of the adjusting wheel (30) and has a recess face (4111). The recess face (4111) of the recess (411) is mounted on the at least one connecting protrusion (33) of the adjusting wheel (30), and is separated from the connecting protrusion (33) of the adjusting wheel (30). The actuating unit (412) is formed on the outer surface of the closed front (41) and aligns with the recess (411). The annular sidewall (42) has an abutting surface (421) and a flange (422). The flange (422) protrudes radially from the annular sidewall (42) and is formed around the open rear of the dial (40).

The cover (50) corresponds to and covers the front opening (111) of the base (10) and has an annular edge, multiple connecting tabs (52), an inner surface, an outer surface and a mounting hole (51). The connecting tabs (52) are formed on and protrude from the annular edge of the cover (50), and correspond to and are mounted detachably in the grooves (112) of the base (10). The mounting hole (51) is mounted around the dial (40), and the inner surface of the cover (50) adjacent to the mounting hole (51) abuts the flange (422) of the dial (40).

The protector (60) is attached to the cover (50) and has a ring (61) and two positioning tabs (62). The ring (61) is mounted around the actuating unit (412) of the dial (40) and has an annular edge. The positioning tabs (62) are bent and respectively protrude from the annular edge of the ring (61) and are attached securely on the outer surface of the cover (50).

The occipital pad (70) is attached to the rear surface of the inner panel (12) of the base (10). The forehead pad (701) may be attached to the band (20).

With further reference to FIGS. 5 and 7, rotating the actuating unit (412) of the dial (40) clockwise drives the adjusting wheel (30). The adjusting wheel (30) rotates and drives the toothed ends (21) of the band (20) to move closely to each other. So, a circumference of the band (20) is adjusted.

Figure 6:
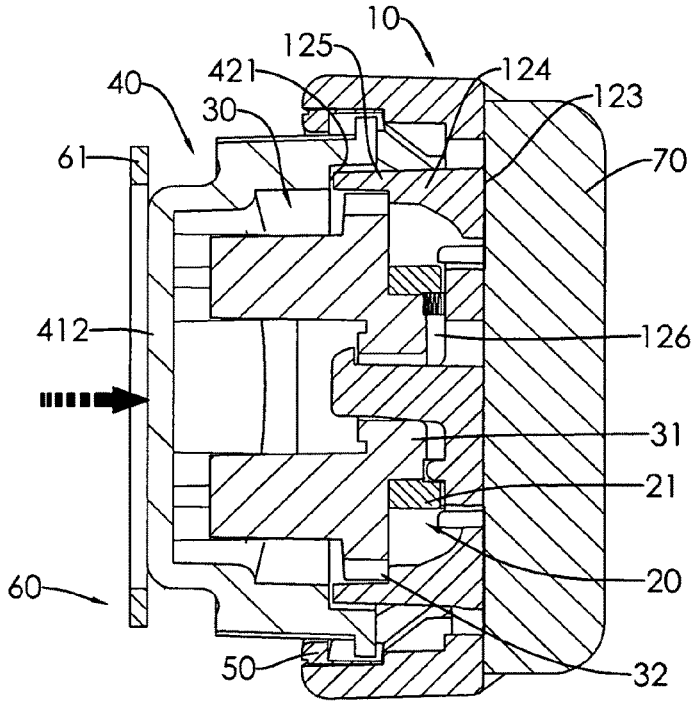
FIG. 6 is an operational end view in partial section of the adjustable head band for a helmet in FIG. 1, the pawl shown disengaging the ratchet wheel.
Figure 8:
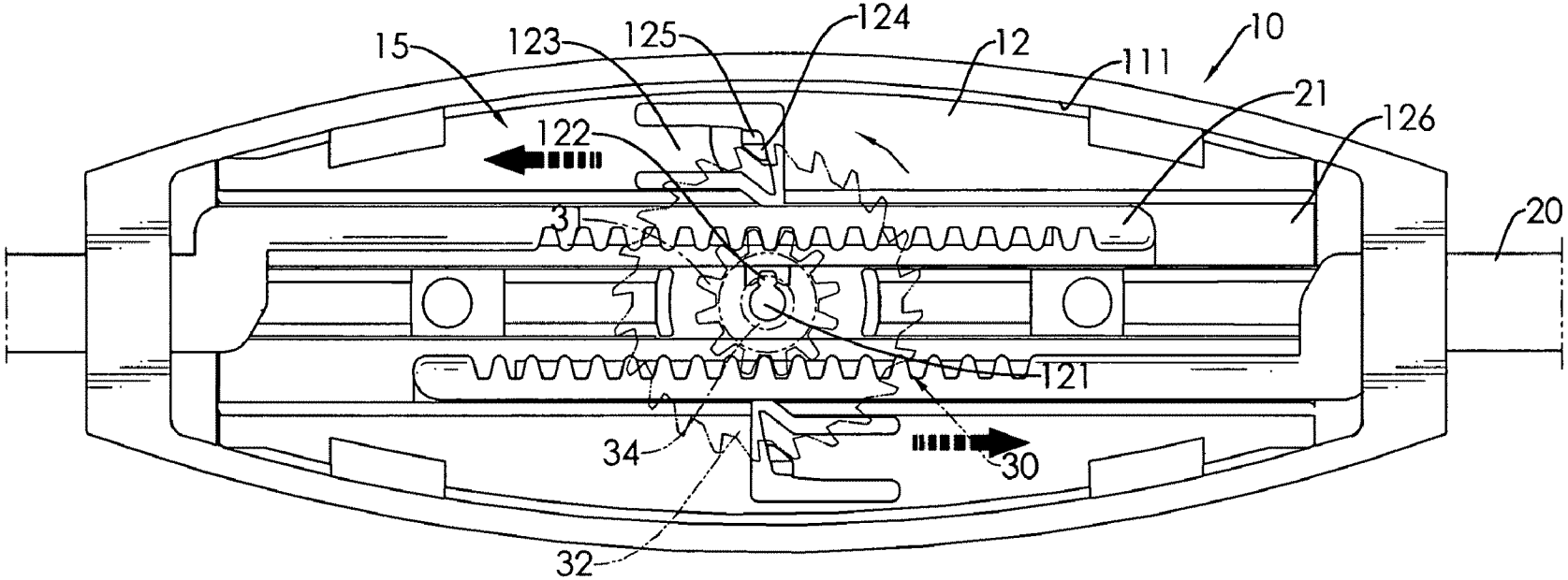
FIG. 8 is a partially operational enlarged front view of internal elements of the adjustable head band for a helmet in FIG. 1, showing the adjusting wheel moving counterclockwise.

With further reference to FIGS. 6 and 8, engagement of the ratchet wheel (32) and the pawls (124) prevents rotation of the dial (40) unless purposeful force is applied.

Figure 9:
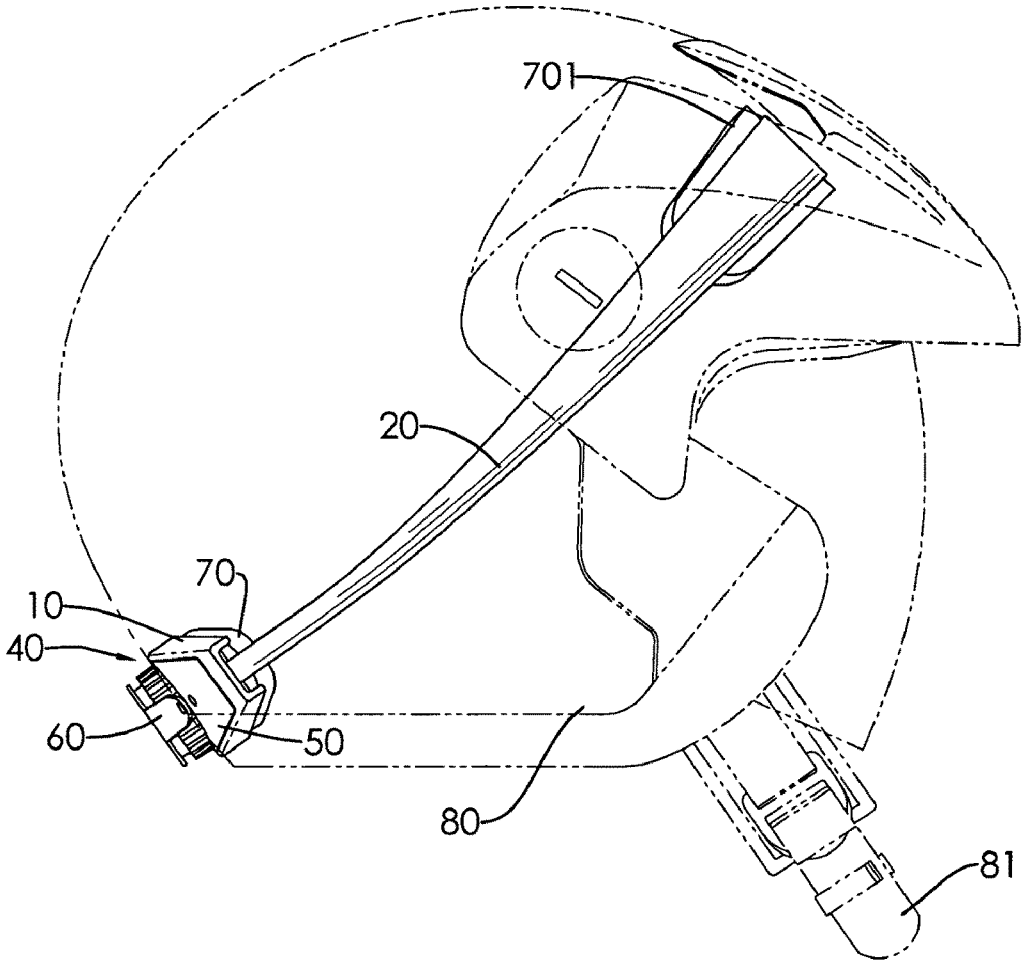
FIG. 9 is an operational end view of the adjustable head band for a helmet in FIG. 1, shown attached to a helmet.

With further reference to FIG. 9, the band (20) is mounted around the inside of the helmet (80). The base (10), the cover (50) and the occipital pad (70) are also mounted inside the helmet (80). The dial (40) and the protector (60) are protruded outside the helmet (80) for easy and convenient adjustment of the band (20) by rotating the dial (40). Therefore, the adjustable head band for a helmet in accordance with the present invention is customizable for different head sizes and shapes. With further use of a chin strap (81), the helmet (80) can be steady on the head and prevent injury. Besides, the protector (60) effectively prevents the size of the band (20) from being changed accidentally.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable head band for a helmet comprising:
- a base having
  - a chamber;
  - a front opening;
  - two slots; and
  - a ratchet mount protruding on the base;
- a band movably mounted through the base and having two toothed ends mounted respectively through the slots of the base and disposed in the chamber of the base, and having teeth facing each other;
- an adjusting wheel mounted on the base and having
  - a gear engaging between the toothed ends of the band;
  - a ratchet wheel attached concentrically to the gear and having a surface;
  - at least one connecting protrusion protruding from the surface of the ratchet wheel; and
  - a center hole formed through the gear and the ratchet wheel and mounted around the ratchet mount of the base;
- a dial mounted rotatably on the adjusting wheel and having
  - a closed front having
    - an inner surface; and
  - a recess formed in the inner surface of the closed front and mounted on the connecting protrusion of the adjusting wheel, and having a recess face separated from the connecting protrusion of the adjusting wheel; and
  - an annular sidewall having an abutting surface; and
- a cover corresponding to and covering the front opening of the base and having a mounting hole mounted around the dial, and
- wherein the base further has at least one resilient sheet formed on the base adjacent to the ratchet mount, and each one of the at least one resilient sheet having
  - a free end;
  - a pawl protruding from the free end of the resilient sheet and having an end; and
  - an abutting protrusion protruding from the end of the pawl; and the ratchet wheel of the adjusting wheel engages the pawl of the base.

2. The adjustable head band for a helmet as claimed in claim 1 further having a protector attached to the cover and having
- a ring mounted around the dial and having an annular edge; and
- two positioning tabs respectively protruding from the annular edge of the ring and attached securely on the cover.

3. The adjustable head band for a helmet as claimed in claim 2, wherein the base further has
- an outer frame having a top side and a bottom side; and
- an inner panel having
  - a top side corresponding to and connected to the top side of the outer frame; and
  - a bottom side corresponding to and connected to the bottom side of the outer frame.

4. The adjustable head band for a helmet as claimed in claim 3, wherein
- the ratchet mount of the base further has an end and a mounting protrusion protruding from the end of the ratchet mount; and
- the center hole of the adjusting wheel has an inside wall abutting the mounting protrusion of the base.

5. The adjustable head band for a helmet as claimed in claim 2, wherein
- the ratchet mount of the base further has an end and a mounting protrusion protruding from the end of the ratchet mount; and the center hole of the adjusting wheel has an inside wall abutting the mounting protrusion of the base.

6. The adjustable head band for a helmet as claimed in claim 1, wherein the base further has an outer frame having a top side and a bottom side; and an inner panel having a top side corresponding to and connected to the top side of the outer frame; and a bottom side corresponding to and connected to the bottom side of the outer frame.

7. The adjustable head band for a helmet as claimed in claim 6, wherein the ratchet mount of the base further has an end and a mounting protrusion protruding from the end of the ratchet mount; and the center hole of the adjusting wheel has an inside wall abutting the mounting protrusion of the base.

8. The adjustable head band for a helmet as claimed in claim 1, wherein the ratchet mount of the base further has an end and a mounting protrusion protruding from the end of the ratchet mount; and the center hole of the adjusting wheel has an inside wall abutting the mounting protrusion of the base.

9. The adjustable head band for a helmet as claimed in claim 1, wherein the dial further has an open rear;

the annular sidewall of the dial further has a flange protruding radially from the annular sidewall of the dial and formed around the open rear of the dial; and the cover further has an inner surface abutting the flange of the dial.

10. The adjustable head band for a helmet as claimed in claim 1 further having an occipital pad attached to the base.

11. The adjustable head band for a helmet as claimed in claim 10 further having a forehead pad attached to the band.

* * * * *